US005941657A

United States Patent [19]

Banze

[11] Patent Number: 5,941,657

[45] Date of Patent: Aug. 24, 1999

[54] FLOOR COVERING MADE UP OF PENTAGONAL CONCRETE MOULDED PARTS WITH JOINTS BETWEEN THEM

[75] Inventor: Henner Banze, Drilon, Germany

[73] Assignee: Heinrich Klostermann GmbH & Co. KG, Coesfeld, Germany

[21] Appl. No.: 09/011,866

[22] PCT Filed: Aug. 9, 1996

[86] PCT No.: PCT/EP96/03517

§ 371 Date: Jun. 9, 1998

§ 102(e) Date: Jun. 9, 1998

[87] PCT Pub. No.: WO97/07285

PCT Pub. Date: Feb. 27, 1997

[30] Foreign Application Priority Data

Aug. 17, 1995 [DE] Germany ..... 195 30 235

[51] Int. Cl.[6] ..... E01C 5/00

[52] U.S. Cl. ..... 404/39; 404/41; 404/42; D25/113

[58] Field of Search ..... 404/34, 37, 38, 404/41, 42, 39; D25/138, 151, 153, 154, 157, 158, 159, 160, 161, 162, 112, 113; D21/478, 479, 484

[56] References Cited

U.S. PATENT DOCUMENTS

| | | | |
|---|---|---|---|
| 2,605,681 | 7/1952 | Trief | 404/41 |
| 3,344,570 | 10/1967 | Marson | D25/138 |
| 3,602,111 | 8/1971 | Clemente | 404/41 |
| 4,973,192 | 11/1990 | Hair | 404/34 |
| 5,046,887 | 9/1991 | Fontana et al. | 404/34 |

FOREIGN PATENT DOCUMENTS 94 04 146 U 5/1994 Germany .

*Primary Examiner*—James A. Lisehora
*Attorney, Agent, or Firm*—Proskauer Rose LLP

[57] ABSTRACT

The invention relates to a ground covering of pentagonal shaped concrete slabs ($F_1$) placed against another with joints. The shaped slabs are simple to produce and simple to lay and in order to give such a covering an appearance similar to a ground covering of irregular quarry slabs each shaped slab has two adjacent straight sides of equal length disposed at an obtuse angle, two adjoining concave sides of equal length and equal curvature, and a convex side disposed therebetween which is twice the length of the concave sides and has a curvature corresponding to the curvature of the concave sides. Together the three shaped slabs form a group of three, the straight sides abutting one another with the formation of a star-shaped joint. The outer convex sides of one group of three abut the concave sides of the adjacent group of three and vice versa.

4 Claims, 2 Drawing Sheets

Figure 1:
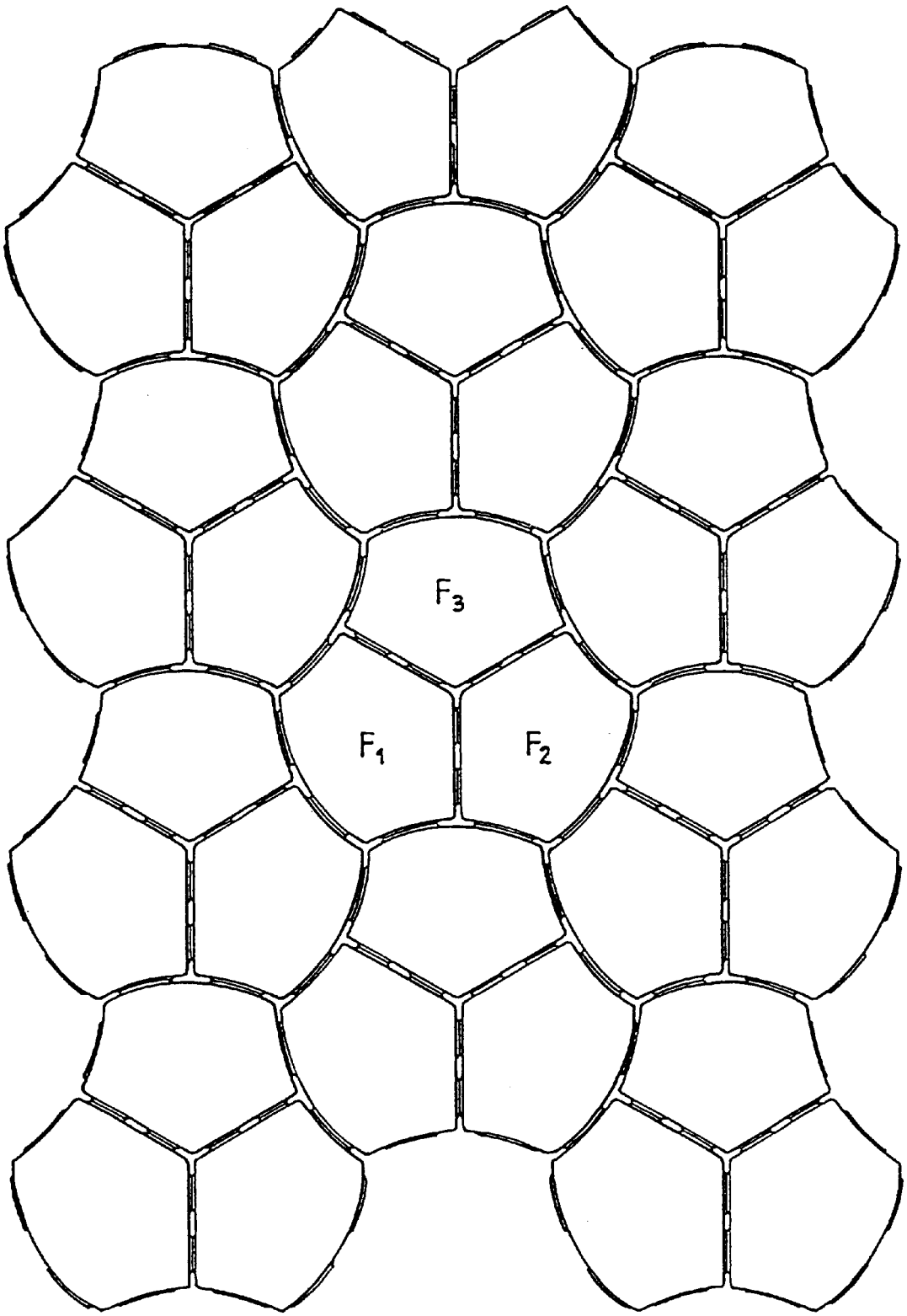

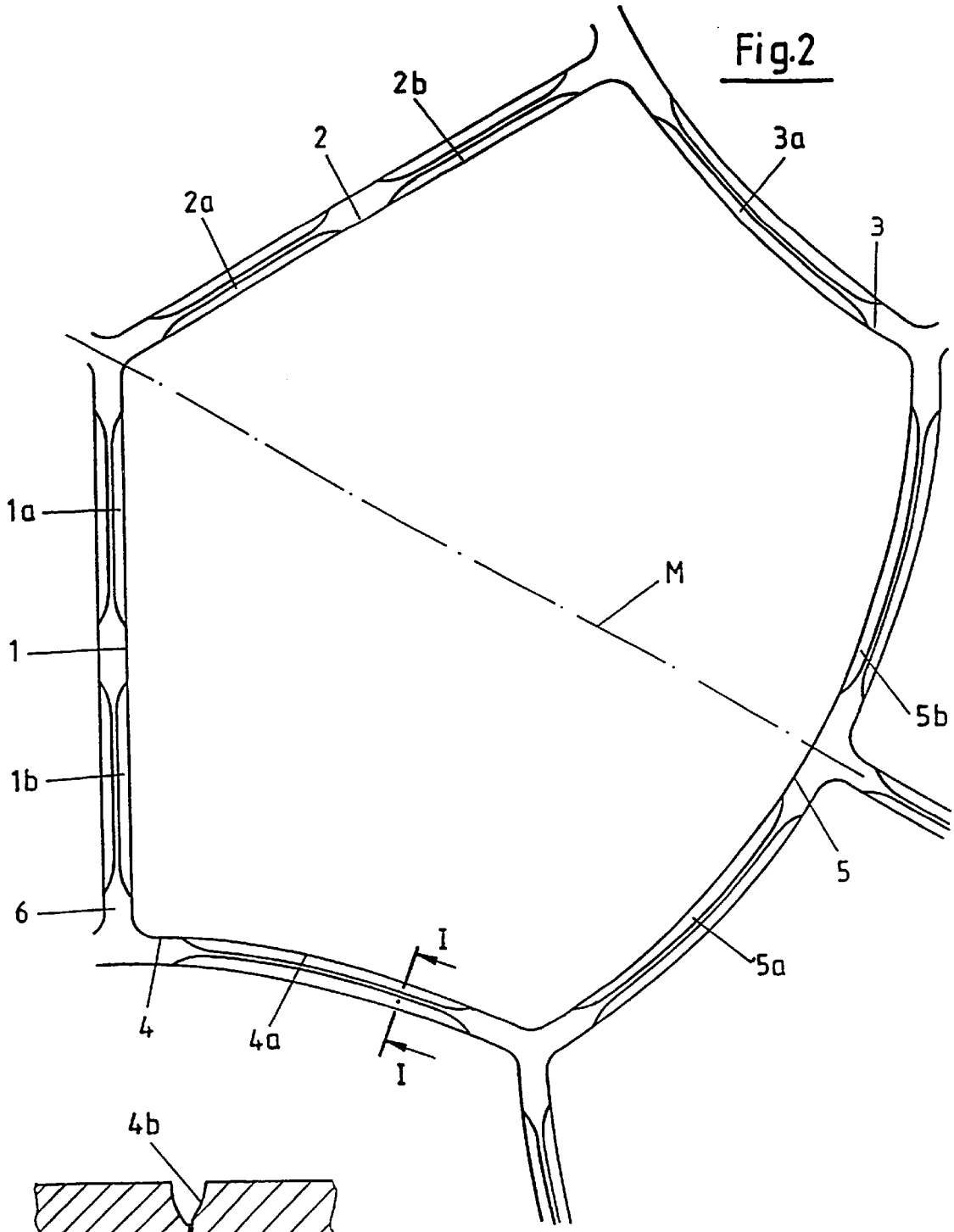
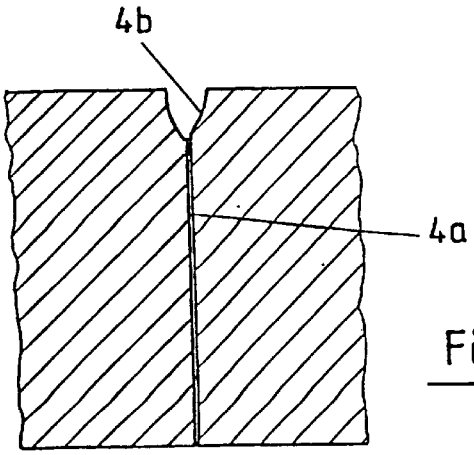
Fig.3

FLOOR COVERING MADE UP OF PENTAGONAL CONCRETE MOULDED PARTS WITH JOINTS BETWEEN THEM

BACKGROUND OF THE INVENTION

The invention relates to a ground covering of pentagonal shaped concrete slabs which abut one another with joints and which each have two adjacent straight sides of equal length disposed at an obtuse angle, two further adjoining sides of equal length and a side disposed therebetween and having a greater length than the further sides of equal length, the slabs forming a group of three with star-shaped joints formed between the abutting further straight sides.

Various constructions are known of ground coverings consisting of polygonal shaped concrete slabs abutting one another with joints. As a rule the shaped slabs have a regular shape which enables the individual slabs to be laid against one another as desired. Such a ground covering often has to enable accumulating surface water to trickle through the joints into the subsoil. To facilitate the removal of surface water, the shaped blocks should not abut one another at their sides, but be places at a distance, with the formation of joints. One disadvantage of such shaped slabs is felt to be that they have a regular shape, as a result of which the appearance of a ground covering is boring by comparison with a ground covering produced from irregular quarry slabs.

In one prior art ground covering of pentagonal shaped concrete slabs abutting one another with joints (DE 0 94 04 146) all the sides are straight. A group of three identical shaped slabs is extended by a fourth identical shaped slab to give a group of four with six corners and an outer contour symmetrical with respect to axes placed perpendicularly on one another. A ground covering made up of such groups of four shaped slabs has a boring appearance in contrast with a ground covering produced from irregular quarry slabs.

It is an object of the invention to produce a ground covering of polygonal shaped concrete slabs which on the one hand can easily be laid but on the other hand has a lively appearance similar to that of irregular quarry slabs.

This problem is solved in a ground covering of the kind specified by the features that the further sides of equal length of each shaped slab have the same concave curvature and the longer side disposed therebetween opposite the straight sides has a convex curvature corresponding to the concave curvature and twice the length of the concave sides, the outer convex sides of one group of three abutting the concave sides of the adjacent groups of three and vice versa.

Although the shaped slabs of such a ground covering all have the same shape, something which simplifies their production and laying, the different shapes of lengths of the sides make the ground covering look completely irregular at first glance and give the covering an appearance similar to that of irregular quarry slabs.

A ground covering of such shaped slabs is also suitable for the effective drainage of surface water, more particularly if according to one feature of the invention the sides of each shaped slab bear over a proportion of their length and height cams acting as joint-forming spacers. In this construction of the invention each side does not need to have spacers; it is enough for one of the abutting sides of two shaped slabs to have a spacer. As regards production and laying, however, it is simpler for all the sides to have such spacers, which then co-operate in pairs. In any case the spacers ensure that a wide enough joint is obtained during laying.

The spacers, which are present only over a proportion of the height of the shaped slabs, should be completely absent in the upper zone, to form a continuous joint at that place.

An embodiment of the invention will now be explained in greater detail with reference to the drawings, which show:

FIG. 1 a plan view of a ground covering formed by pentagonal shaped slabs abutting one another with joints, FIG. 2 a plan view of an enlarged detailed shaped slab with adjoining shaped slabs as in FIG. 1, and FIG. 3 a cross-section through two adjacent shaped slabs, taken along the line I—I in FIG. 2.

A shaped concrete slab shown to an enlarged scale in FIG. 2 has a shape symmetrical with respect to the line M. It has two straight sides 1, 2 enclosing an obtuse angle, two concave sides 3, 4 adjoining the straight sides 1, 2, and a convex side 5 which is disposed therebetween and whose length is twice the length of each of the concave sides 3, 4, its curvature corresponding to the curvature of the concave sides 3, 4. Formed to act as joint-forming spacers on each of the sides 1–5 are cams 1*a*, 1*b*, 2*a*, 2*b*, 3*a*, 4*a*, 5*a*, 5*b* which extend over only a proportion of the length of the corresponding sides 1–5 and practically over the whole height of the sides 1–5. They are somewhat retracted only at the top edge 4*b*. The spacers 1*a*, 1*b*, 2*a*, 2*b*, 3*a*, 4*a*, 5*a*, 5*b* co-operate with corresponding spacers of adjacent shaped slabs to determine the width of the joints 6 between the shaped slabs. The joints receive sand or some other granular material and drain surface water to the subsoil.

As shown by FIG. 1, in the laying of the shaped slabs three shaped slabs $F_1$, $F_2$, $F_3$ abut one another by their straight sides 1, 2, forming a group of three, with the formation of star-shaped joints. The outsides of the group of three are alternately convex and concave, all the sides having the same length. Disposed around such a group of three are six identical groups of three, convex and concave sides engaging in one another. Such laying ensures that only three joints ever impinge on one another at each place of intersection. This is an advantage for the permanent positioning of the shaped slabs in use.

I claim:

1. A ground covering, comprising:

pentagonal shaped slabs ($F_1$, $F_2$, $F_3$) which abut one another with joints and which each have two adjacent straight sides (1, 2) of equal length disposed at an obtuse angle to one another, two further adjoining sides (3, 4) of equal length and a longer side (5) disposed therebetween, the slabs forming a group of three with star-shaped joints (6) formed between the abutting adjacent straight sides (1, 2);

the further adjoining sides (3, 4) of equal length of each shaped slab ($F_1$, $F_2$, $F_3$) having the same concave curvature; and the longer side (5) disposed between the further adjoining sides (3, 4) opposite the adjacent straight sides (1, 2) having a convex curvature corresponding to the concave curvature of the further adjoining sides (3, 4) and twice the length thereof, the outer convex longer sides (5) of one group of three of said shaped slabs ($F_1$, $F_2$, $F_3$) abutting the concave further adjoining sides (3, 4) of adjacent groups of three shaped slabs and vice versa.

2. A ground covering according to claim 1, wherein the sides (1–5) of each said shaped slabs ($F_1$, $F_2$, $F_3$) bear, over a proportion of their length and a height, cams acting as joint-forming spacers (1*a*, 1*b*, 2*a*, 2*b*, 3*a*, 4*a*, 5*a*, 5*b*).

3. A ground covering according to claim 2, wherein the spacers (1*a*, 1*b*, 2*a*, 2*b*, 3*a*, 4*a*, 5*a*, 5*b*) are retracted in a zone (4*b*) of a top edge of the shaped slab.

4. A paving block for the formation of a ground covering when placed in abutted engagement with others of like shape, the paving block comprising:

a prismatic envelope defined by upper and lower surfaces connected by five ascending sides;

the ascending sides including two adjacent straight sides approximately equal in length to one another and arranged at an obtuse angle of approximately 120° with one another, two curved sides approximately equal in length to one another, and a connecting side disposed therebetween having a length approximately equal to twice a length of each of said two curved sides;

each of said two curved sides having an approximately equal concave curvature; and said connecting side having a convex curvature corresponding approximately to said concave curvature of the two curved sides, whereby three of said paving blocks can be symmetrically arranged in a circular grouping in which all of said adjacent straight sides are juxtaposed to remaining others in the grouping and in which a pair comprised of one of said two curved sides on each of two adjacent ones of said paving blocks in the grouping lie adjacent one another thereby forming a continuous concave curved region defined by the pair of curved sides on said adjacent two paving blocks, and plural groupings can be arranged to evenly divide an area upon which they are placed, wherein said connecting sides on each of the groupings is aligned with, and juxtaposed to, said concave curved region on corresponding remaining others of said groupings.

* * * * *